US011069287B2

(12) United States Patent
Zhu et al.

(10) Patent No.: US 11,069,287 B2
(45) Date of Patent: Jul. 20, 2021

(54) DRIVER CONTROL CIRCUIT AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Lixin Zhu, Beijing (CN); Ruilian Li, Beijing (CN); Lei Shi, Beijing (CN); Xueqin Wei, Beijing (CN); Bingbing Yan, Beijing (CN); Chunyang Nie, Beijing (CN); Ke Dai, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 9 days.

(21) Appl. No.: 16/665,049

(22) Filed: Oct. 28, 2019

(65) Prior Publication Data

US 2020/0219442 A1 Jul. 9, 2020

(30) Foreign Application Priority Data

Jan. 3, 2019 (CN) ..... 201910005763.8

(51) Int. Cl.
*G09G 3/3225* (2016.01)
*G09G 3/36* (2006.01)

(52) U.S. Cl.
CPC ..... *G09G 3/3225* (2013.01); *G09G 3/3648* (2013.01); *G09G 2310/0294* (2013.01)

(58) Field of Classification Search
CPC ..... G09G 3/3225; G09G 3/3648; G09G 2310/0294
See application file for complete search history.

(56) References Cited

U.S. PATENT DOCUMENTS

| | | | | |
|---|---|---|---|---|
| 10,629,129 | B2 * | 4/2020 | Xiao | G09G 3/3614 |
| 10,762,813 | B2 * | 9/2020 | Yuan | G09G 3/006 |
| 2005/0099380 | A1 * | 5/2005 | Sase | G09G 3/3648 345/100 |
| 2005/0190167 | A1 * | 9/2005 | Olson | G09G 3/3406 345/204 |
| 2015/0008871 | A1 * | 1/2015 | Petenyi | G05F 1/625 320/107 |
| 2015/0188431 | A1 * | 7/2015 | Cho | H02M 3/158 345/212 |
| 2018/0218675 | A1 * | 8/2018 | Zhang | H02H 9/041 |

FOREIGN PATENT DOCUMENTS

| | | | |
|---|---|---|---|
| CN | 206077778 U | * | 4/2017 |
| CN | 107066019 A | * | 8/2017 |

* cited by examiner

*Primary Examiner* — Amare Mengistu
*Assistant Examiner* — Jennifer L Zubajlo
(74) *Attorney, Agent, or Firm* — Arent Fox LLP; Michael Fainberg

(57) ABSTRACT

A driver control circuit and a display device are disclosed, where the driver control circuit includes: a first transistor with a first terminal connected with a supply voltage of a main loop, and a second terminal connected with a first ground terminal; and a first control component connected with a control terminal of the first transistor, and configured to control the first transistor to be in a state of incomplete conduction in amplification region, when the supply voltage of the main loop is powered on.

16 Claims, 3 Drawing Sheets

DRIVER CONTROL CIRCUIT AND DISPLAY DEVICE

CROSS-REFERENCE TO RELATED APPLICATION

This disclosure claims priority to Chinese Patent Application No. 201910005763.8, filed on Jan. 3, 2019, the content of which is incorporated by reference in the entirety.

TECHNICAL FIELD

The disclosure relates to the field of circuit control technology, and particularly to a driver control circuit and a display device.

DESCRIPTION OF THE RELATED ART

As the sciences and technologies are advancing, various manufacturers have focused their researches on an 8K display device.

In the related art, when a supply voltage for a main loop of the 8K display device is powered on, there is such large instantaneous current due to a high load and a high inductive capacitance that an element in the loop may be easily damaged, and thus a service lifetime of the element may be shortened, and also a driver Integrated Circuit (IC) of the display device may be easily damaged irreversibly.

SUMMARY

In an aspect, embodiments of the disclosure provide a driver control circuit including: a first transistor, wherein a first terminal of the first transistor is connected with a supply voltage of a main loop, and a second terminal of the first transistor is connected with a first ground terminal; and a first control component connected with a control terminal of the first transistor, and configured to control the first transistor to be in a state of incomplete conduction in amplification region, when the supply voltage of the main loop is powered on.

In some embodiments, the first control component is configured to: adjust, when the supply voltage of the main loop is powered on, a first drive voltage output to the control terminal of the first transistor according to current in the main loop, to control the first transistor to be in the state of incomplete conduction in amplification region.

In some embodiments, the first control component includes: a sampling circuit configured to acquire the current in the main loop, and to generate a sampling voltage according to the current in the main loop, wherein a first terminal of the sampling circuit is connected with the second terminal of the first transistor; a differential amplifying circuit connected respectively with the first terminal of the sampling circuit and a second terminal of the sampling circuit, and configured to differentially amplify the sampling voltage to obtain a first voltage; an isolating and sampling circuit connected with the differential amplifying circuit, and configured to isolate the first voltage to obtain a second voltage; and an integral amplifying circuit connected respectively with the isolating and sampling circuit, and the control terminal of the first transistor, and configured to calculate a difference between a set third voltage and the second voltage, to integrally amplify the difference to obtain the first drive voltage, and to output the first drive voltage to the control terminal of the first transistor.

In some embodiments, the first control component further includes: a first diode, wherein the integral amplifying circuit is connected with the control terminal of the first transistor through the first diode, and an anode of the first diode is connected with the integral amplifying circuit, and a cathode of the first diode is connected with the control terminal of the first transistor.

In some embodiments, the driver control circuit further includes: a second control component connected with the control terminal of the first transistor, and configured to control the first transistor to be in a state of complete conduction in saturation region, after the supply voltage of the main loop is powered on.

In some embodiments, the second control component is configured to: generate and output, after the supply voltage of the main loop is powered on, a second drive voltage, which is higher than the first drive voltage, to the control terminal of the first transistor according to an input control signal to control the first transistor to be in the state of complete conduction in saturation region.

In some embodiments, the second control component includes: a control circuit configured to generate a fourth voltage according to the control signal; and a push-pull circuit connected respectively with the control circuit, and the control terminal of the first transistor, and configured to generate the second drive voltage according to the fourth voltage.

In some embodiments, the control circuit includes: a control signal input terminal configured to be input with the control signal; and a photoelectric coupler connected respectively with the control signal input terminal and the push-pull circuit, and configured to be turned on under control of the control signal to generate the fourth voltage.

In some embodiments, the push-pull circuit includes: a second transistor, wherein a control terminal of the second transistor is connected with the control circuit, and configured to be turned on under control of the fourth voltage, a first terminal of the second transistor is configured to be input with a first isolation voltage, and a second terminal of the second transistor is connected with the control terminal of the first transistor, and configured to output the second drive voltage; and a third transistor, wherein a first terminal of the third transistor is connected with the second terminal of the second transistor, a second terminal of the third transistor is connected with the first ground terminal, and a control terminal of the third transistor is connected with the control circuit, and configured to be turned on under the control of the fourth voltage.

In some embodiments, the driver control circuit further includes: an isolation power circuit connected respectively with the supply voltage of the main loop, the first control component and the second control component, and configured to generate an operating voltage or an isolation operating voltage for the first control component and the second control component according to the supply voltage of the main loop.

In another aspect, the embodiments of the disclosure further provide a display device including a driver control circuit, wherein the driver control circuit includes: a first transistor, wherein a first terminal of the first transistor is connected with a supply voltage of a main loop, and a second terminal of the first transistor is connected with a first ground terminal; and a first control component connected with a control terminal of the first transistor, and configured to control the first transistor to be in a state of incomplete conduction in amplification region, when the supply voltage of the main loop is powered on.

In some embodiments, the first control component is configured to: adjust, when the supply voltage of the main loop is powered on, a first drive voltage output to the control terminal of the first transistor according to current in the main loop, to control the first transistor to be in the state of incomplete conduction in amplification region.

In some embodiments, the first control component includes: a sampling circuit configured to acquire the current in the main loop, and to generate a sampling voltage according to the current in the main loop, wherein a first terminal of the sampling circuit is connected with the second terminal of the first transistor; a differential amplifying circuit connected respectively with the first terminal of the sampling circuit and a second terminal of the sampling circuit, and configured to differentially amplify the sampling voltage to obtain a first voltage; an isolating and sampling circuit connected with the differential amplifying circuit, and configured to isolate the first voltage to obtain a second voltage; and an integral amplifying circuit connected respectively with the isolating and sampling circuit, and the control terminal of the first transistor, and configured to calculate a difference between a set third voltage and the second voltage, to integrally amplify the difference to obtain the first drive voltage, and to output the first drive voltage to the control terminal of the first transistor.

In some embodiments, the first control component further includes: a first diode, wherein the integral amplifying circuit is connected with the control terminal of the first transistor through the first diode, and an anode of the first diode is connected with the integral amplifying circuit, and a cathode of the first diode is connected with the control terminal of the first transistor.

In some embodiments, the driver control circuit further includes: a second control component connected with the control terminal of the first transistor, and configured to control the first transistor to be in a state of complete conduction in saturation region, after the supply voltage of the main loop is powered on.

In some embodiments, the second control component is configured to: generate and output, after the supply voltage of the main loop is powered on, a second drive voltage, which is higher than the first drive voltage, to the control terminal of the first transistor according to an input control signal to control the first transistor to be in the state of complete conduction in saturation region.

In some embodiments, the second control component includes: a control circuit configured to generate a fourth voltage according to the control signal; and a push-pull circuit connected respectively with the control circuit, and the control terminal of the first transistor, and configured to generate the second drive voltage according to the fourth voltage.

In some embodiments, the control circuit includes: a control signal input terminal configured to be input with the control signal; and a photoelectric coupler connected respectively with the control signal input terminal and the push-pull circuit, and configured to be turned on under control of the control signal to generate the fourth voltage.

In some embodiments, the push-pull circuit includes: a second transistor, wherein a control terminal of the second transistor is connected with the control circuit, and configured to be turned on under control of the fourth voltage, a first terminal of the second transistor is configured to be input with a first isolation voltage, and a second terminal of the second transistor is connected with the control terminal of the first transistor, and configured to output the second drive voltage; and a third transistor, wherein a first terminal of the third transistor is connected with the second terminal of the second transistor, a second terminal of the third transistor is connected with the first ground terminal, and a control terminal of the third transistor is connected with the control circuit, and configured to be turned on under the control of the fourth voltage.

In some embodiments, the driver control circuit further includes: an isolation power circuit connected respectively with the supply voltage of the main loop, the first control component and the second control component, and configured to generate an operating voltage or an isolation operating voltage for the first control component and the second control component according to the supply voltage of the main loop.

BRIEF DESCRIPTION OF THE DRAWINGS

In order to make the technical solutions according to the embodiments of the disclosure more apparent, the drawings to which a description of the embodiments refers will be briefly introduced below, and apparently the drawings to be described below are merely illustrative of some of the embodiments of the disclosure, and those ordinarily skilled in the art can derive from these drawings other drawings without any inventive effort.

DETAILED DESCRIPTION OF THE EMBODIMENTS

Figure 1:
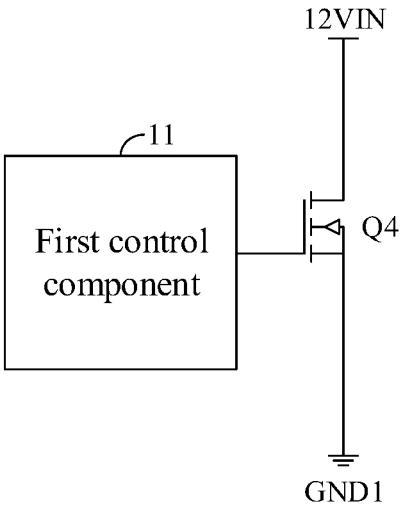
FIG. 1 is a schematic structural diagram of a driver control circuit according to the embodiments of the disclosure.

The embodiments of the disclosure will be described below in details, and examples of the embodiments are illustrated in the drawings, where identical or like reference numerals will refer to identical or like elements, or elements with identical or like functions throughout the drawings. The embodiments to be described below with reference to the drawings are exemplary, and only intended to set forth the disclosure, but the disclosure will not be limited thereto.

The driver control circuit and the display device according to the embodiments of the disclosure will be described below with reference to the drawings.

FIG. 1 is a schematic structural diagram of a driver control circuit according to the embodiments of the disclosure, and as illustrated in FIG. 1, the driver control circuit includes: a first transistor Q4 with a first terminal connected with a supply voltage 12VIN of a main loop, and a second terminal connected with a first ground terminal GND1; and a first control component 11 connected with a control terminal of the first transistor Q4, and configured to control the first transistor Q4 to be in a state of incomplete conduction in amplification region when the supply voltage 12VIN of the main loop is powered on.

In some embodiments, the first transistor Q4 can be a Metal Oxide Semiconductor (MOS) transistor as illustrated in FIG. 1, the first terminal of the first transistor Q4 can be a drain of the MOS transistor, the second terminal of the first transistor Q4 can be a source of the MOS transistor, and the control terminal of the first transistor Q4 can be a gate of the MOS transistor. The first terminal of the first transistor Q4 is connected with the supply voltage 12Vin of the main loop, the second terminal of the first transistor Q4 is connected with the first ground terminal GND1, and the first control component 11 is connected with the control terminal of the first transistor Q4; and when the supply voltage 12VIN of the main loop is powered on, the first control component 11 controls the first transistor Q4 to be in the state of incomplete conduction in amplification region to thereby control current in the main loop so as to limit the current and raise the voltage gradually, to protect an element in the loop and a driver IC of the display device, and to prolong the service lifetime of the element and the display device.

In some embodiments, the first control component 11 can adjust a first drive voltage V4 output to the control terminal of the first transistor Q4 according to the current I in the main loop to thereby control the first transistor Q4 to be in the state of incomplete conduction in amplification region. For example, when I is relatively low, the first control component 11 can raise the first drive voltage V4 output to the control terminal of the first transistor Q4 to thereby control the first transistor Q4 to be in the state of incomplete conduction in amplification region, and raise I so as to gradually raise the current I in the main loop. And when I is relatively high, the first control component 11 can lower the first drive voltage V4 output to the control terminal of the first transistor Q4 to thereby control the first transistor Q4 to be in the state of incomplete conduction in amplification region, and lower I so as to limit the current I in the main loop.

In the driver control circuit according to the embodiments of the disclosure, the first terminal of the first transistor is connected with the supply voltage of the main loop, the second terminal of the first transistor is connected with the first ground terminal, and the first control component is connected with the control terminal of the first transistor; and when the supply voltage of the main loop is powered on, the first control component controls the first transistor to be in the state of incomplete conduction in amplification region to thereby control the current in the main loop so as to limit the current and raise the voltage gradually, to protect an element in the loop and the driver IC of the display device, and to prolong the service lifetime of the element and the display device.

Figure 2:
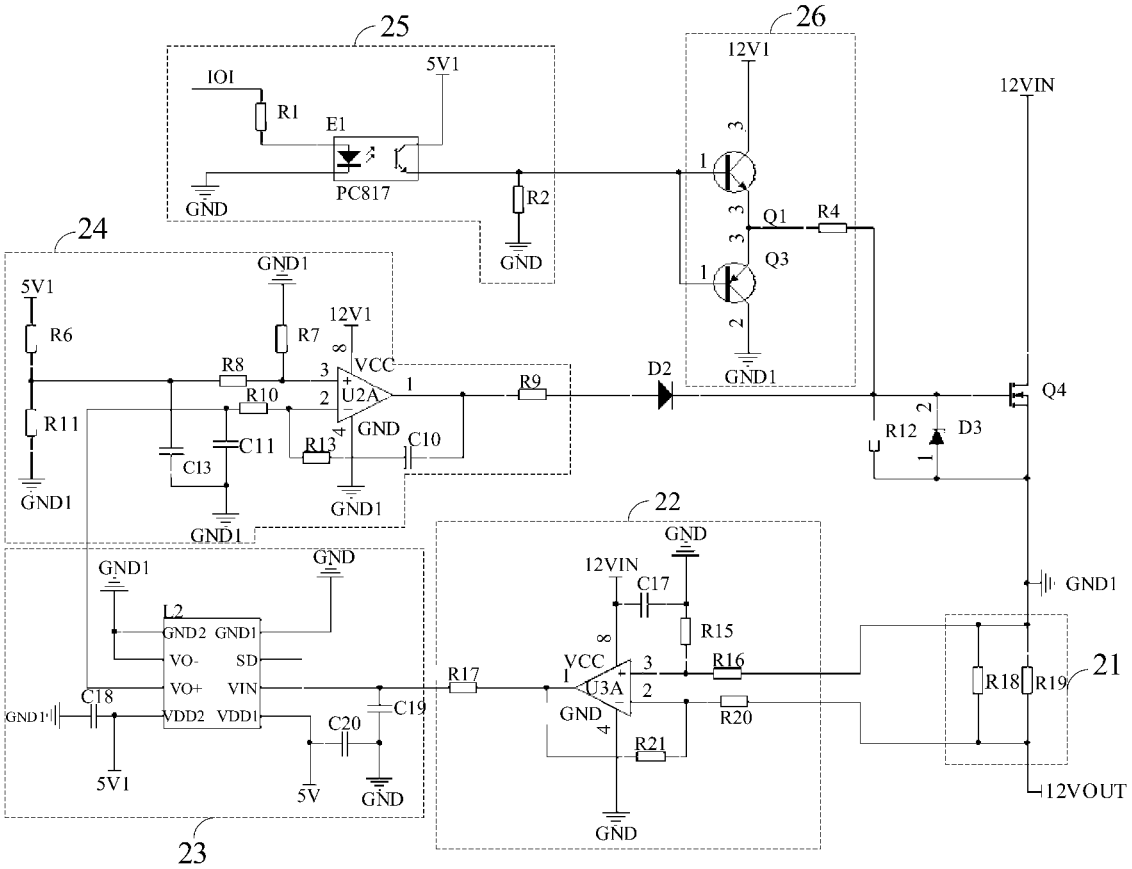
FIG. 2 is a schematic circuit diagram of the driver control circuit according to the embodiments of the disclosure.

FIG. 2 is a schematic circuit diagram of the driver control circuit according to the embodiments of the disclosure, and as illustrated in FIG. 2, further to the embodiments as illustrated in FIG. 1, the first control component can further include a sampling circuit 21, a differential amplifying circuit 22, an isolating and sampling circuit 23, and an integral amplifying circuit 24.

The sampling circuit 21 has a first terminal connected with the second terminal of the first transistor Q4, and is configured to acquire the current I in the main loop, and to generate a sampling voltage ΔV according to the current I in the main loop.

In some embodiments, as illustrated in FIG. 2, the sampling circuit 21 can include sampling resistors R18 and R19, and when the supply voltage 12VIN of the main loop is powered on, the current I in the main loop can be acquired through R18 and R19, and the sampling voltage $\Delta V = I^* (R18^* R19)/(R18+R19)$ can be generated according to the acquired current I in the main loop.

The differential amplifying circuit 22 is connected respectively with the first terminal of the sampling circuit 21 and a second terminal of the sampling circuit 21, and configured to differentially amplify the sampling voltage ΔV to obtain a first voltage V1.

In some embodiments, as illustrated in FIG. 2, the differential amplifying circuit 22 can include the supply voltage 12VIN of the main loop, a ground terminal GND, resistors R15, R16, R17, R20, and R21, a capacitor C17, and a differential amplifier U3A. The differential amplifying circuit 22 is connected respectively with the first terminal and the second terminal of the sampling circuit 21, and in some embodiments, as illustrated in FIG. 2, a pin 3 of U3A in the differential amplifying circuit 22 is connected with first terminals of R18 and R19 in the sampling circuit 21 through R16, and a pin 2 of U3A is connected with second terminals of R18 and R19 in the sampling circuit 21 through R20; and the sampling circuit 21 obtains and then outputs the sampling voltage ΔV to U3A in the differential amplifying circuit 22, and U3A differentially amplifies ΔV to obtain the first voltage V1, and outputs it at a pin 1 of U3A.

The isolating and sampling circuit 23 is connected with the differential amplifying circuit 22, and configured to isolate the first voltage V1 to obtain a second voltage V2.

In some embodiments, as illustrated in FIG. 2, the isolating and sampling circuit 23 can include: an isolation chip L2; a ground terminal GND connected with a pin GND1 of L2; a first ground terminal GND1 connected with a pin GND2 of L2; a supply voltage 5V (i.e., 5V un-isolated voltage) connected with an input pin VDD1 of L2, and configured to provide the input pin VDD1 of L2 with 5V voltage, where the supply voltage 5V, and the supply voltage 12VIN of the main loop are grounded together at a voltage reference ground GND; a supply voltage 5V1 (5V isolation voltage) connected with an output pin VDD2 of L2, and configured to provide the output pin VDD2 of L2 with 5V1 voltage, where a voltage reference ground of the supply voltage 5V1 is GND1; and capacitors C18, C19, and C20. The isolating and sampling circuit 23 is connected with the differential amplifying circuit 22, and in some embodiments, as illustrated in FIG. 2, a pin VIN of L2 in the isolating and sampling circuit 23 is connected with the pin 1 of U3A in the differential amplifying circuit 22, the pin 1 of U3A outputs the first voltage V1 to the pin VIN of L2, and L2 isolates V1, and obtains the second voltage V2, which is output at a pin VO+.

The integral amplifying circuit 24 is connected respectively with the isolating and sampling circuit 22, and the control terminal of the first transistor Q4, and configured to calculate a difference V3-V2 between a set third voltage V3 and the second voltage V2, to integrally amplify the voltage difference V3-V2 to obtain the first drive voltage V4, and to output the first drive voltage V4 to the control terminal of the first transistor Q4.

In some embodiments, as illustrated in FIG. 2, the integral amplifying circuit 24 can include: an integral amplifier U2A; the supply voltage 5V1; a supply voltage 12V1 (i.e., 12V isolation voltage with the voltage reference ground GND1); the first ground terminal GND1; resistors R6, R7, R8, R9, R10, R11, and R13, where R6 and R11 are voltage dividing resistors configured to divide the supply voltage 5V1 to obtain the set third voltage V3, and R7, R8, R10, and R13 are configured to determine an amplification factor P of U2A; and capacitors C10, C11, and C13, where C10 is an integral capacitor configured to prevent voltage from being amplified by a suddenly varying factor. The integral amplifying circuit 24 is connected with the isolating and sampling circuit 23, and in some embodiments, as illustrated in FIG. 2, the pin VO+ of L2 in the isolating and sampling circuit 23 is connected with the pin 2 of U2A through R10, the isolating and sampling circuit 23 obtains and then outputs the second voltage V2 to the pin 2 of U2A, the supply voltage 5V1 is divided by R6 and R11, and then the set third voltage V3 is generated and output to the pin 3 of U2A, and U2A calculates the difference between the set third voltage V3 and the second voltage V2 as V3-V2, integrally amplifies the voltage difference V3-V2 to obtain the first drive voltage V4=P*(V3-V2), and outputs V4 to the control terminal of the first transistor Q4.

The driver control circuit according to the embodiments of the disclosure limits the current and raises the voltage gradually under the following principle.

(1) When the supply voltage 12VIN of the main loop is powered on, if the current I in the main loop is relatively large, then the sampling voltage ΔV generated by the sampling circuit 21, the first voltage V1 obtained by the differential amplifying circuit 22, and the second voltage V2 obtained by the isolating and sampling circuit 23 will be relatively high; and since the set third voltage V3 has a fixed value, when V2 is relatively high, the first drive voltage V4=P*(V3-V2) obtained by the integral amplifying circuit 24 will be relatively low, so the voltage output to the control terminal of the first transistor Q4 will be lowered, Q4 will be in the state of incomplete conduction in amplification region, and the current I in the main loop will be lowered, so that Q4 can limit the current I in the main loop.

(2) When the supply voltage 12VIN of the main loop is powered on, if the current I in the main loop is relatively small, then the sampling voltage ΔV generated by the sampling circuit 21, the first voltage V1 obtained by the differential amplifying circuit 22, and the second voltage V2 obtained by the isolating and sampling circuit 23 will be relatively low; and since the set third voltage V3 has a fixed value, when V2 is relatively low, the first drive voltage V4=P*(V3-V2) obtained by the integral amplifying circuit 24 will be relatively high, so the voltage output to the control terminal of the first transistor Q4 will be raised, Q4 will be the in the state of incomplete conduction in amplification region, and the current I in the main loop will be raised, so that Q4 can gradually raise the current I in the main loop.

In some embodiments, as illustrated in FIG. 2, the first control component can further include: a first diode D2, where the integral amplifying circuit 24 is connected with the control terminal of the first transistor Q4 through the first diode D2, and the first diode D2 has an anode connected with the integral amplifying circuit 24, and a cathode connected with the control terminal of the first transistor Q4.

In some embodiments, the driver control circuit can further include: a second control component connected with the control terminal of the first transistor Q4, and configured to control the first transistor Q4 to be in a state of complete conduction in saturation region, after the supply voltage 12VIN of the main loop is powered on.

In the embodiments of the disclosure, after the supply voltage 12VIN of the main loop is powered on, the second control component controls the first transistor Q4 to be in the state of complete conduction in saturation region to thereby lower power consumption of Q4 so that current is output normally from the main loop. In some embodiments, the second control component can generate and output a second drive voltage, which is higher than the first drive voltage V4, to the control terminal of the first transistor Q4 according to an input control signal to control the first transistor Q4 to be in the state of complete conduction in saturation region.

In some embodiments, as illustrated in FIG. 2, the second control component can include a control circuit 25 and a push-pull circuit 26. The control circuit 25 is configured to generate a fourth voltage according to the control signal.

In some embodiments, the control circuit 25 can include: a control signal input terminal IOI configured to be input with the control signal; and a photoelectric coupler E1 connected respectively with the control signal input terminal IOI and the push-pull circuit 26, and configured to be turned on under the control of the control signal to generate the fourth voltage, where the control signal can be a high-level signal. In some embodiments, as illustrated in FIG. 2, the control circuit 25 can further include: resistors R1 and R2, a ground terminal GND, and a supply voltage 5V1.

The push-pull circuit 26 is connected respectively with the control circuit 25, and the control terminal of the first transistor Q4, and configured to generate the second drive voltage according to the fourth voltage.

In some embodiments, the push-pull circuit 26 can include: a second transistor Q1, where a control terminal of the second transistor Q1 is connected with the control circuit 25, and configured to be turned on under the control of the fourth voltage, a first terminal of the second transistor Q1 is configured to be input with a first isolation voltage 12V1, and a second terminal of the second transistor Q1 is connected with the control terminal of the first transistor Q4, and configured to output the second drive voltage; and a third transistor Q3, where a first terminal of the third transistor Q3 is connected with the second terminal of the second transistor Q1, a second terminal of the third transistor Q3 is connected with the first ground terminal GND1, and a control terminal of the third transistor Q3 is connected with the control circuit 25 and configured to be turned on under the control of the fourth voltage. Where the second transistor Q1 and the third transistor Q3 can be triodes as illustrated in FIG. 2, the control terminal of Q1 can be a base of the triode, the first terminal of Q1 can be a collector of the triode, and the second terminal of Q1 can be an emitter of the triode; and the control terminal of Q3 can be a base of the triode, the first terminal of Q3 can be an emitter of the triode, and the second terminal of Q3 can be a collector of the triode. Further, as illustrated in FIG. 2, the push-pull circuit 26 can further include a resistor R4.

An operating principle of the second control component in the driver control circuit according to the embodiments of the disclosure is as follows.

After the supply voltage 12VIN of the main loop is powered on, a control signal is input to the control signal input terminal IOI, the photoelectric coupler E1 is turned on under the control of the control signal, and generates and outputs the fourth voltage to the control terminals of the second transistor Q1 and the third transistor Q3, Q1 and Q3 are turned on under the control of the fourth voltage, and a loop between the first isolation voltage 12V1 and Q4 becomes conductive so that the first isolation voltage 12V1 is output to the control terminal of Q4 (both 12V1 and V4 are connected with the first ground terminal GND1, and 12V1 is higher than V4, so D2 is in a reverse cut-off state) to control the first transistor Q4 to be in the state of complete conduction in saturation region so as to lower power consumption of Q4 so that current is output normally from the main loop.

In some embodiments, the driver control circuit can further include a voltage-regulator diode D3 and a resistor R12.

In the driver control circuit according to the embodiments of the disclosure, the first terminal of the first transistor is connected with the supply voltage of the main loop, and the second terminal of the first transistor is connected with the first ground terminal; and the first control component is connected with the control terminal of the first transistor, and when the supply voltage of the main loop is powered on, the first control component controls the first transistor to be in a state of incomplete conduction in amplification region to thereby control the current in the main loop so as to limit the current and raise the voltage gradually, to protect an element in the main loop and the driver IC of the display device, and to prolong the service lifetime of the element and the display device.

Figure 3:
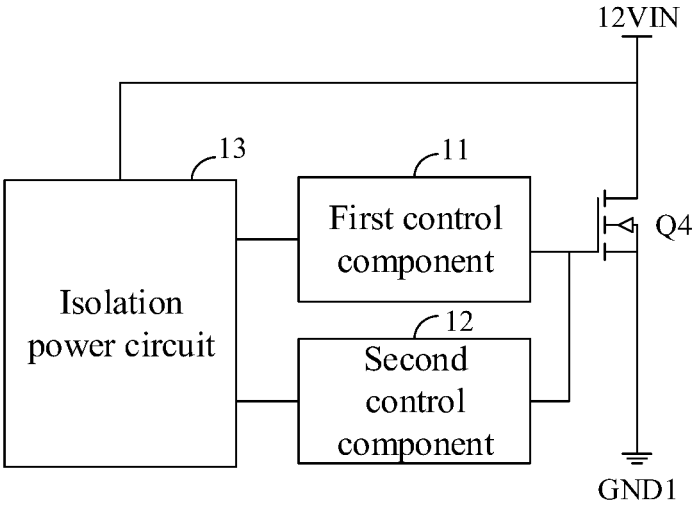
FIG. 3 is another schematic structural diagram of the driver control circuit according to the embodiments of the disclosure.

In some embodiments, as illustrated in FIG. 3 which is another schematic structural diagram of the driver control circuit according to the embodiments of the disclosure, the driver control circuit can further include an isolation power circuit 13 on the basis of the embodiments as illustrated in FIG. 1, where: the isolation power circuit 13 is connected respectively with the supply voltage 12VIN of the main loop, the first control component 11 and the second control component 12, and configured to generate an operating voltage or an isolation operating voltage for the first control component 11 and the second control component 12 according to the supply voltage 12VIN of the main loop.

Figure 4:
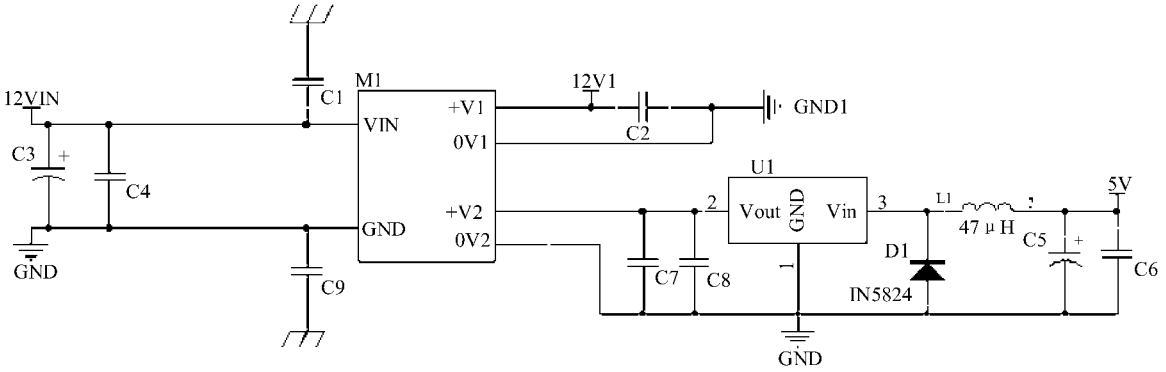
FIG. 4 is another schematic circuit diagram of the driver control circuit according to the embodiments of the disclosure.
Figure 4:
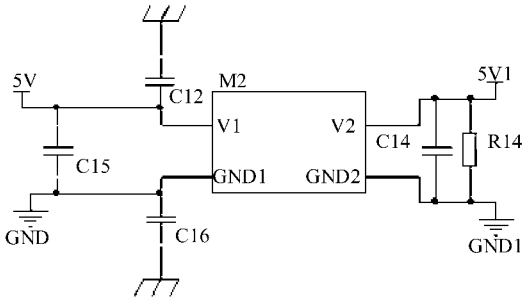

In some embodiments, as illustrated in FIG. 4 which is another schematic circuit diagram of the driver control circuit according to the embodiments of the disclosure, the isolation power circuit 13 can include: the supply voltage 12VIN of the main loop, a ground terminal GND, a first ground terminal GND1, capacitors C1, C2, C3, C4, C5, C6, C7, C8, C9, C12, C14, C15, and C16, a first isolation power sub-circuit M1, a second isolation power sub-circuit M2, an inductor L1, a diode D1, a resistor R14, supply voltage 5V, supply voltage 5V1, and supply voltage 12V1.

The supply voltage 12VIN of the main loop is isolated by the first isolation power sub-circuit M1, and then transformed into the supply voltage 12V1 and the supply voltage 5V1, where the supply voltage 12V1 can provide the first control component 11 with isolation operating voltage, and for example, can provide the integral amplifying circuit 24 in the first control component 11 with 12V isolation operating voltage, and the supply voltage 12V1 can further provide the second control component 12 with isolation operating voltage, and for example, can provide the push-pull circuit 26 in the second control component 12 with isolation operating voltage; and the supply voltage 5V is isolated by the second isolation power sub-circuit M2, and then transformed into the supply voltage 5V1, and the supply voltage 5V1 can provide the first control component 11 with the isolation operating voltage, and for example, can provide the isolating and sampling circuit 23 in the first control component 11 with the isolation operating voltage; and the supply voltage 5V1 can further provide the second control component 12 with isolation operating voltage, and for example, can provide the control circuit 25 in the second control component 12 with isolation operating voltage.

In the driver control circuit according to the embodiments of the disclosure, the isolation power circuit can generate the operating voltage or the isolation operating voltage for the first control component and the second control component according to the supply voltage of the main loop.

Figure 5:
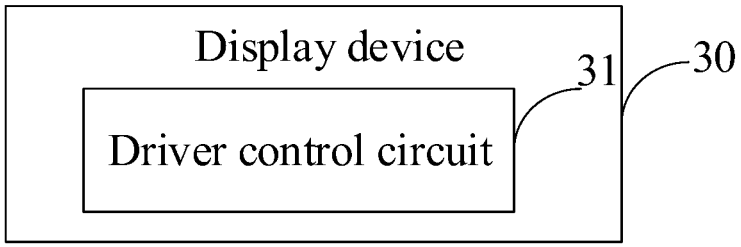
FIG. 5 is a schematic structural diagram of a display device according to the embodiments of the disclosure.

Based upon the same inventive concept, the embodiments of the disclosure further provides a display device 30 as illustrated in FIG. 5, which includes the driver control circuit 31 according to any one of the embodiments of the disclosure above. The display device can be a liquid crystal display panel, electronic paper, an OLED panel, a mobile phone, a tablet computer, a TV set, monitor, a notebook computer, a digital photo frame, a navigator, or any other product or component with a display function.

In the description of this specification, the reference terms "an embodiment", "some embodiments", "an example", "some examples", etc., refer to that particular feature(s), structure(s), material(s), or characteristic(s) described in connection with the embodiment(s) or the example(s) are included in at least one embodiment or example of the disclosure. In this specification, an exemplary description of the terms may not necessarily refer to the same embodiment or example. Further, the described particular features, structures, materials, or characteristics may be combined as appropriate in any one or more embodiments or examples. Moreover, those skilled in the art can combine the different embodiments or examples described in this specification, or the features in the different embodiments or examples with each other unless they conflict with each other.

Although the embodiments of the disclosure have been illustrated and described above, it can be appreciated that the embodiments above are exemplary, and shall not be construed as limiting the disclosure, and those ordinarily skilled in the art can make changes, modifications, alternatives, and variations to the embodiments above without departing from the scope of the disclosure.

The invention claimed is:

1. A driver control circuit, comprising:

a first transistor, wherein a first terminal of the first transistor is connected with a supply voltage of a main loop, and a second terminal of the first transistor is connected with a first ground terminal; and a first control component connected with a control terminal of the first transistor, and configured to adjust, when the supply voltage of the main loop is powered on, a first drive voltage output to the control terminal of the first transistor according to current in the main loop, to control the first transistor to be in the state of incomplete conduction in amplification region;

wherein the first control component comprises:

a sampling circuit configured to acquire the current in the main loop, and to generate a sampling voltage according to the current in the main loop, wherein a first terminal of the sampling circuit is connected with the second terminal of the first transistor;

a differential amplifying circuit connected respectively with the first terminal of the sampling circuit and a second terminal of the sampling circuit, and configured to differentially amplify the sampling voltage to obtain a first voltage;

an isolating and sampling circuit connected with the differential amplifying circuit, and configured to isolate the first voltage to obtain a second voltage; and an integral amplifying circuit connected respectively with the isolating and sampling circuit, and the control terminal of the first transistor, and configured to calculate a difference between a set third voltage and the second voltage, to integrally amplify the difference to obtain the first drive voltage, and to output the first drive voltage to the control terminal of the first transistor.

2. The driver control circuit according to claim 1, wherein the first control component further comprises:

a first diode, wherein the integral amplifying circuit is connected with the control terminal of the first transistor through the first diode, and an anode of the first diode is connected with the integral amplifying circuit, and a cathode of the first diode is connected with the control terminal of the first transistor.

3. The driver control circuit according to claim 1, wherein the driver control circuit further comprises:

a second control component connected with the control terminal of the first transistor, and configured to control the first transistor to be in a state of complete conduction in saturation region, after the supply voltage of the main loop is powered on.

4. The driver control circuit according to claim 3, wherein the second control component is configured to:

generate and output, after the supply voltage of the main loop is powered on, a second drive voltage, which is higher than the first drive voltage, to the control terminal of the first transistor according to an input control signal to control the first transistor to be in the state of complete conduction in saturation region.

5. The driver control circuit according to claim 4, wherein the second control component comprises:

a control circuit configured to generate a fourth voltage according to the control signal; and a push-pull circuit connected respectively with the control circuit, and the control terminal of the first transistor, and configured to generate the second drive voltage according to the fourth voltage.

6. The driver control circuit according to claim 5, wherein the control circuit comprises:

a control signal input terminal configured to be input with the control signal; and a photoelectric coupler connected respectively with the control signal input terminal and the push-pull circuit, and configured to be turned on under control of the control signal to generate the fourth voltage.

7. The driver control circuit according to claim 5, wherein the push-pull circuit comprises:

a second transistor, wherein a control terminal of the second transistor is connected with the control circuit, and configured to be turned on under control of the fourth voltage, a first terminal of the second transistor is configured to be input with a first isolation voltage, and a second terminal of the second transistor is connected with the control terminal of the first transistor, and configured to output the second drive voltage; and a third transistor, wherein a first terminal of the third transistor is connected with the second terminal of the second transistor, a second terminal of the third transistor is connected with the first ground terminal, and a control terminal of the third transistor is connected with the control circuit, and configured to be turned on under the control of the fourth voltage.

8. The driver control circuit according to claim 3, wherein the driver control circuit further comprises:

an isolation power circuit connected respectively with the supply voltage of the main loop, the first control component and the second control component, and configured to generate an operating voltage or an isolation operating voltage for the first control component and the second control component according to the supply voltage of the main loop.

9. A display device comprising a driver control circuit, wherein the driver control circuit comprises:

a first transistor, wherein a first terminal of the first transistor is connected with a supply voltage of a main loop, and a second terminal of the first transistor is connected with a first ground terminal; and a first control component connected with a control terminal of the first transistor, and configured to adjust, when the supply voltage of the main loop is powered on, a first drive voltage output to the control terminal of the first transistor according to current in the main loop, to control the first transistor to be in the state of incomplete conduction in amplification region;

wherein the first control component comprises:

a sampling circuit configured to acquire the current in the main loop, and to generate a sampling voltage according to the current in the main loop, wherein a first terminal of the sampling circuit is connected with the second terminal of the first transistor;

a differential amplifying circuit connected respectively with the first terminal of the sampling circuit and a second terminal of the sampling circuit, and configured to differentially amplify the sampling voltage to obtain a first voltage;

an isolating and sampling circuit connected with the differential amplifying circuit, and configured to isolate the first voltage to obtain a second voltage; and an integral amplifying circuit connected respectively with the isolating and sampling circuit, and the control terminal of the first transistor, and configured to calculate a difference between a set third voltage and the second voltage, to integrally amplify the difference to obtain the first drive voltage, and to output the first drive voltage to the control terminal of the first transistor.

10. The display device according to claim 9, wherein the first control component further comprises:

a first diode, wherein the integral amplifying circuit is connected with the control terminal of the first transistor through the first diode, and an anode of the first diode is connected with the integral amplifying circuit, and a cathode of the first diode is connected with the control terminal of the first transistor.

11. The display device according to claim 9, wherein the driver control circuit further comprises:

a second control component connected with the control terminal of the first transistor, and configured to control the first transistor to be in a state of complete conduction in saturation region, after the supply voltage of the main loop is powered on.

12. The display device according to claim 11, wherein the second control component is configured to:

generate and output, after the supply voltage of the main loop is powered on, a second drive voltage, which is higher than the first drive voltage, to the control terminal of the first transistor according to an input control signal to control the first transistor to be in the state of complete conduction in saturation region.

13. The display device according to claim 12, wherein the second control component comprises:

a control circuit configured to generate a fourth voltage according to the control signal; and a push-pull circuit connected respectively with the control circuit, and the control terminal of the first transistor, and configured to generate the second drive voltage according to the fourth voltage.

14. The display device according to claim 13, wherein the control circuit comprises:

a control signal input terminal configured to be input with the control signal; and a photoelectric coupler connected respectively with the control signal input terminal and the push-pull circuit, and configured to be turned on under control of the control signal to generate the fourth voltage.

15. The display device according to claim 13, wherein the push-pull circuit comprises:

a second transistor, wherein a control terminal of the second transistor is connected with the control circuit, and configured to be turned on under control of the fourth voltage, a first terminal of the second transistor is configured to be input with a first isolation voltage, and a second terminal of the second transistor is connected with the control terminal of the first transistor, and configured to output the second drive voltage; and a third transistor, wherein a first terminal of the third transistor is connected with the second terminal of the second transistor, a second terminal of the third transistor is connected with the first ground terminal, and a control terminal of the third transistor is connected with the control circuit, and configured to be turned on under the control of the fourth voltage.

16. The display device according to claim 11, wherein the driver control circuit further comprises:

an isolation power circuit connected respectively with the supply voltage of the main loop, the first control component and the second control component, and configured to generate an operating voltage or an isolation operating voltage for the first control component and the second control component according to the supply voltage of the main loop.

* * * * *